US010526903B2

(12) United States Patent
Giannozzi et al.

(10) Patent No.: US 10,526,903 B2
(45) Date of Patent: Jan. 7, 2020

(54) METHOD OF PROTECTING A COMPONENT OF A TURBOMACHINE FROM LIQUID DROPLETS EROSION, COMPONENT AND TURBOMACHINE

(71) Applicant: Nuovo Pignone Srl, Florence (IT)

(72) Inventors: Massimo Giannozzi, Florence (IT); Michelangelo Bellacci, Florence (IT); Federico Iozzelli, Florence (IT); Gabriele Masi, Florence (IT)

(73) Assignee: Thermodyne SAS, LeCreusot (FR)

( * ) Notice: Subject to any disclaimer, the term of this patent is extended or adjusted under 35 U.S.C. 154(b) by 405 days.

(21) Appl. No.: 15/302,506

(22) PCT Filed: Apr. 2, 2015

(86) PCT No.: PCT/EP2015/057336
§ 371 (c)(1),
(2) Date: Oct. 7, 2016

(87) PCT Pub. No.: WO2015/155119
PCT Pub. Date: Oct. 15, 2015

(65) Prior Publication Data

US 2017/0051616 A1 Feb. 23, 2017

(30) Foreign Application Priority Data

Apr. 9, 2014 (IT) ..... CO2014A0010

(51) Int. Cl.
*F01D 5/28* (2006.01)
*F04D 17/10* (2006.01)
(Continued)

(52) U.S. Cl.
CPC ..... *F01D 5/288* (2013.01); *F04D 17/10* (2013.01); *F04D 29/023* (2013.01); *F04D 29/444* (2013.01); *F05D 2230/90* (2013.01)

(58) Field of Classification Search
CPC . F01D 5/288; F01D 5/28; F01D 5/286; F04D 17/10; F04D 29/023; F04D 29/444; F05D 2230/90
See application file for complete search history.

(56) References Cited

U.S. PATENT DOCUMENTS 3,951,612 A 4/1976 Gates et al.
5,071,693 A 12/1991 Jiinjen
(Continued)

FOREIGN PATENT DOCUMENTS

CN 101528641 A 9/2009
CN 101675183 A 3/2010
(Continued)

OTHER PUBLICATIONS

International Search Report and Written Opinion dated Jun. 3, 2015 which was issued in connection with PCT Patent Application No. PCT/EP2015/057336 which was filed on Apr. 2, 2015.
(Continued)

*Primary Examiner* — Igor Kershteyn
(74) *Attorney, Agent, or Firm* — Baker Hughes Patent Organization

(57) ABSTRACT

The method of protecting a component of a turbomachine from liquid droplets erosion provides covering at least one region of a component surface exposed to a flow of a fluid containing a liquid phase to be processed by the turbomachine with a protective layer. The protective layer consists of a plurality of adjacent sub-layers of different materials having high hardness in the range of 1000-3000 HV and low fracture toughness below 20 $MPam^{1/2}$. The materials are typically nitrides or carbides of titanium or aluminum or chromium or tungsten. In an embodiment, the covering is carried out by a PVD technique, in particular by Cathodic Arc PVD, or a CVD technique. The method may be applied
(Continued)

to any component of turbomachines, but it may be particularly beneficial for parts of centrifugal compressors.

21 Claims, 3 Drawing Sheets

(51) Int. Cl.
*F04D 29/02* (2006.01)
*F04D 29/44* (2006.01)

(56) References Cited

U.S. PATENT DOCUMENTS 5,275,850 A * 1/1994 Kitoh ..... C23C 16/26 427/122
6,099,976 A * 8/2000 Lemelson ..... C23C 4/02 428/623
6,780,509 B2 * 8/2004 Reiss ..... C23C 28/00 416/241 B
7,247,348 B2 * 7/2007 Power ..... F01D 5/288 204/192.1
2004/0213675 A1 * 10/2004 Blangetti ..... F01D 5/288 416/241 R
2009/0123737 A1 5/2009 Yasui et al.
2010/0304181 A1 * 12/2010 Anand ..... C23C 4/12 428/627
2011/0135946 A1 * 6/2011 Konno ..... C23C 16/26 428/448
2011/0262770 A1 * 10/2011 Torigoe ..... C04B 35/486 428/633

FOREIGN PATENT DOCUMENTS

CN 101876327 A 11/2010
EP 2 312 018 A1 4/2011
EP 2312018 A1 4/2011
RU 2 491 368 C2 8/2013
WO 03/044374 A1 5/2003
WO 03044374 A1 5/2003

OTHER PUBLICATIONS

Italian Search Report and Written Opinion dated Dec. 9, 2014 which was issued in connection with Italian Patent Application No. CO2014A000010 which was filed on Apr. 9, 2014.
Machine Translation of First Office Action and Search issued in connection with corresponding CN Application No. 201580018050.5 dated Sep. 26, 2017.
Office Action and Search Report issued in connection with corresponding RU Application No. 2016138579 dated Oct. 9, 2018.

* cited by examiner

METHOD OF PROTECTING A COMPONENT OF A TURBOMACHINE FROM LIQUID DROPLETS EROSION, COMPONENT AND TURBOMACHINE

BACKGROUND

Embodiments of the subject matter disclosed herein relate to methods of protecting a component of a turbomachine from liquid droplets erosion, components of turbomachines protected according to such methods and turbomachines comprising such components.

In the field of turbomachines for oil & gas applications, two types of erosions affect the parts that get in contact with the flowing working fluid that is processed by the machine: solid particles erosion, in short SPE, and liquid droplets erosion, in short LDE. These two types of erosions are very different due to the different consistency of the elements hitting on the surfaces of such parts: hard bodies that erode the surface and bounce away after collision and soft bodies that hammer the surface and break into smaller soft bodies after collision.

An erosion-protected part may be entirely made of a single material resistant to erosion or, more frequently, may consists of a body made of a material specifically adapted to the function of the part covered with a protective layer made of a material resistant to erosion.

Typically, in order to protect against solid particles erosion hard materials are used while in order to protect against liquid droplets erosion tough materials are used.

Very hard materials do not provide good results in case of hitting liquid droplets due to the fact that typically they are not tough enough to resist to hammering.

Due to the increased performances requested in the field of turbomachines for oil & gas applications, there is always a need for improved solutions, including solutions to the problem of erosion. Embodiments of the present invention deal with liquid droplets erosion.

BRIEF DESCRIPTION

Solid particles erosion proceed in a uniform way; as it is shown in FIG. 1, the erosion rate is approximately constant.

However, liquid droplets erosion does not proceed in a uniform way. As it is shown in FIG. 2, there is an initial period P1, so-called "incubation period", when there is basically no material loss; there is an intermediate period P2 when material loss increases very rapidly and more than linearly; there is a final period P3 when the erosion rate is approximately constant. When a protective layer is used, the layer is completely removed after some time that usually correspond to the sum of period P1 and part of period P2 depending on the width of the layer—see FIG. 3.

It is very difficult to realize a thick (e.g. tens of microns) and compact protective layer of hard material firmly connected to the substrate. Usually, the thickness of such layer may only reach few microns and therefore its erosion protection effect is relatively short.

By using a protective layer consisting of a plurality of sub-layers of different materials having high hardness and low fracture toughness, there is an initial "incubation period", but then erosion proceeds very slowly and approximately linearly—see FIG. 4; according to a simplified description of the phenomenon, the various sub-layers are eroded slowly one after the other.

Furthermore, each sub-layer is compact and is firmly connected to the sub-layer below; therefore, it is possible to cover a body with a thick protective layer; thickness of such layer may reach 70 microns and therefore its protection effect is relatively long.

Some coatings suppliers have recently started offering on the market protective layers consisting of a plurality of sub-layers of different materials having high hardness and low toughness for protection against erosion due to fine, medium and large particles.

A person skilled in the art could not have expected that such layers would have given good results for liquid droplets erosion due to the reasons set out above.

Protective layers can be used consisting of a plurality of sub-layers of different materials having high hardness and low fracture toughness such layers in turbomachines, in particular in centrifugal compressors, in particular (but not only) for their closed centrifugal impellers.

In an embodiment, the technology used for applying such layer (to be precise each sub-layer of the layer) is Physical Vapor Deposition, in short PVD, more specifically Cathodic Arc PVD, or Chemical Vapor Deposition, in short CVD.

With regard to closed centrifugal impellers, it is to be noted that the regions of the flow channels surfaces mostly affected by liquid droplets are the inlet zone and the outlet zone; PVD is a line-of-sight process, but, fortunately, for these zones, it is possible to locate and shape the "targets" so that they can be see directly or indirectly (i.e. through continuous rotation of the impeller) and be covered.

First exemplary embodiments relate to methods of protecting a component of a turbomachine from liquid droplets erosion, comprising covering at least one region of a component surface exposed to a flow of a fluid containing a liquid phase to be processed by the turbomachine with a protective layer; the protective layer comprises a plurality of adjacent sub-layers of different materials; the materials have high hardness in the range of 1000-3000 HV and low fracture toughness below 20 $MPam^{1/2}$.

The materials are two and are arranged in alternate position.

The first material of the two materials is a stoichiometric nitride or carbide or boride of titanium or zirconium or chromium or tungsten or aluminum or vanadium.

The second material of the two materials is a non-stoichiometric nitride or carbide or boride of titanium or zirconium or chromium or tungsten or aluminum or vanadium.

Second exemplary embodiments relate to components of a centrifugal compressor having a surface exposed to a flow of a fluid containing a liquid phase to be compressed by the centrifugal compressor; at least one region of the surface is covered with a protective layer; the protective layer comprises a plurality of adjacent sub-layers of two materials in alternate position; the materials have high hardness in the range of 1000-3000 HV and low fracture toughness below 20 $MPam^{1/2}$.

Third exemplary embodiments relate to turbomachines comprising at least one component as set out above or wherein the methods as set out above have been applied.

BRIEF DESCRIPTION OF DRAWINGS

Embodiments of the present invention will become more apparent from the following description of exemplary embodiments to be considered in conjunction with accompanying drawings wherein.

DETAILED DESCRIPTION

The following description of exemplary embodiments refers to the accompanying drawings. The same reference numbers in different drawings identify the same or similar elements. The following detailed description does not limit the application. Instead, the scope of the application is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
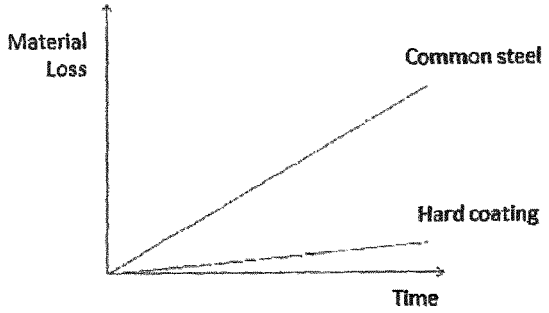
FIG. 1 shows a plot of material loss due to solid particles erosion against time for bulk material.
Figure 2:
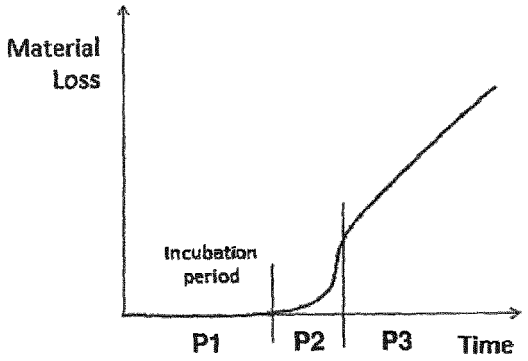
FIG. 2 shows a plot of material loss due to liquid droplets erosion against time for bulk material.
Figure 3:
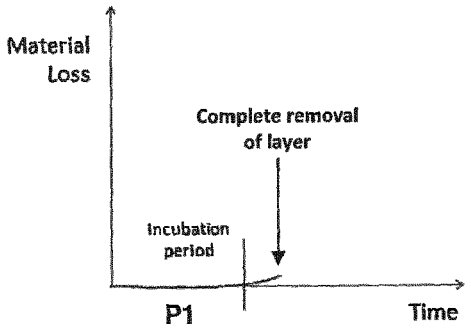
FIG. 3 shows a plot of material loss due to liquid droplets erosion against time for a layer of a single material.
Figure 4:
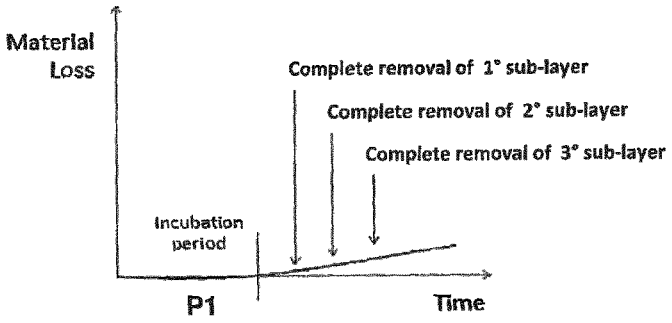
FIG. 4 shows a plot of material loss due to liquid droplets erosion against time for a layer made of a plurality of sub-layers according to an embodiment of the present invention.
Figure 5:
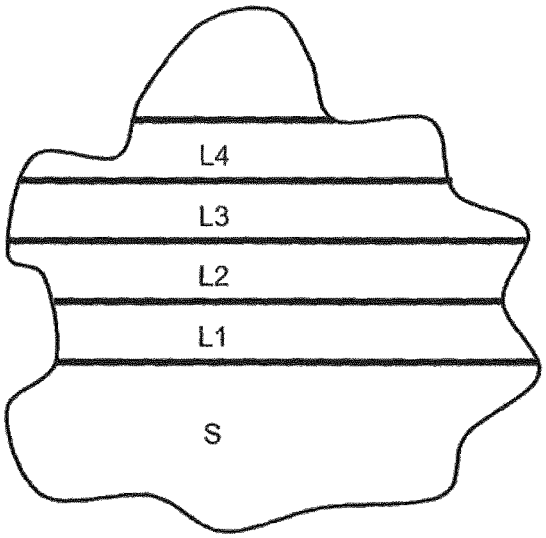
FIG. 5 shows a schematic cross-section of an embodiment of a layer according to an embodiment of the present invention covering a surface of a component of a turbomachine.

FIG. 5 shows a schematic cross-section of an embodiment of a layer according to the present invention covering a surface of a component of a turbomachine; in this figure, reference S corresponds to the substrate, i.e. to the body of the component; there are four overlying sub-layers L1, L2, L3, L4 that have substantially the same width that constitute a protective layer.

Sub-layers L1, L2, L3, L4 are of different materials, all of them having high hardness in the range of 1000-3000 HV and low fracture toughness below 20 $MPam^{1/2}$.

The materials of the sub-layers are selected from the group comprising nitrides, carbides and borides of one or more substances; these substances are selected from the group comprising titanium, zirconium, chromium, tungsten, aluminum and vanadium.

Typically, the protective layer comprises a plurality of adjacent sub-layers of two materials in alternate position; a first material of the two materials and a second material of the two materials are a nitride, carbide or boride of titanium, zirconium, chromium, tungsten, aluminum or vanadium; examples of such material are TiN and TiAlN. With reference to FIG. 5, for example, sub-layers L1 and L3 are made of the first material and sub-layers L2 and L4 are made of the second material.

In the embodiment of FIG. 5, sub-layers L1 and L3 are made of a compound in stoichiometric composition (in particular TiN), and sub-layers L2 and L4 are made of the same compound in non-stoichiometric composition (in particular TiN); these two materials have slightly different high hardness and slightly different low toughness. These sub-layers generate a protection that has low toughness, due to the non-stoichiometric composition, and high hardness, due to the stoichiometric composition.

The widths of such sub-layers may be different or substantially equal and in the range from 0.1 microns to 5.0 microns, more particularly in the range from 0.3 microns to 3.0 microns; if different, one may be e.g. 0.5 microns and the other e.g. 2.0 or 2.5 microns.

The total number of sub-layers may vary from a minimum of 2 to a maximum of 30; more typical values are in the range 5-10.

The total width of the protective layer may vary from a minimum of 10 microns to a maximum of 70 microns; more typical values are in the range 15-30 microns.

A first very effective way to realize the covering of the component according to an embodiment of the present invention is by the technology known as "Chemical Vapor Deposition", in short CVD.

A second very effective way to realize the covering of the component according to an embodiment of the present invention is by the technology known as "Physical Vapor Deposition", in short PVD, more specifically Cathodic Arc PVD.

As it is known, the Cathodic Arc PVD technology uses "targets" for realizing the deposition on the part to be covered; typically, the "targets" are located and/or shaped so that at least the targets see directly the region of the part to be covered by deposition.

According to an embodiment of the present invention, as some regions of the surfaces of the components to be covered may be difficult to reach even if the location and shape of the targets are appropriately studied, the rotation of the component during the PVD process may be used for reaching difficult regions (this will be more clear in the following); in this sense, it may be said that the "targets" are located and/or shaped so that at least the targets see indirectly the region of the part to be covered by deposition.

The first sub-layer, i.e. the sub-layer (L1 in FIG. 5) bonded to substrate (S in FIG. 5) could be completely different from other sub-layers in order to optimize the adhesion of the layer to the substrate; for example, it may be a thick Nickel "strike" made by electroless nickel plating, in short ENP, or by electroplating.

A layer according to an embodiment of the present invention may be applied to any part of a turbomachine, for example selected parts of centrifugal compressors, axial compressors and steam turbines that are likely to be exposed to liquid droplets collisions; in the case of compressors, liquid droplets are more likely in the first stage or stages; in the case of steam turbines, liquid droplets are more likely in the last stage or stages.

One of the most useful applications of the protective layer according to an embodiment of the present invention is in centrifugal compressors.

In centrifugal compressors, at least in some of them (i.e. those wherein the working fluid contains water that may be consist in droplets and/or turn into droplets), there are many components that may be covered entirely or, more frequently partially, with a protective layer according to an embodiment of the present invention.

Figure 6:
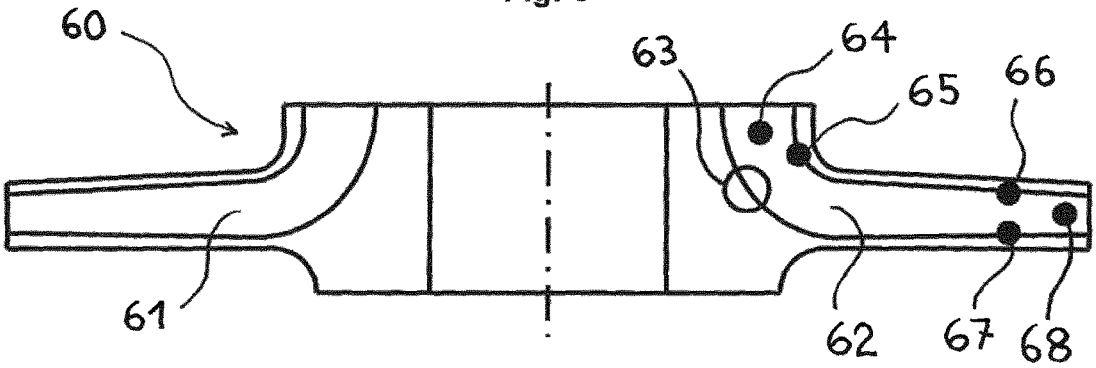
FIG. 6 shows a schematic cross-section of an embodiment of a closed centrifugal impeller according to an embodiment of the present invention.

The component of the centrifugal compressor may be an impeller and the surface that is exposed to fluid flow containing a liquid phase and that is covered by the protective layer may correspond to the whole internal surfaces of the flow channels. In case of a closed impeller (i.e. realized as a single piece), the surface that is exposed to fluid flow containing a liquid phase and that is covered by the protective layer corresponds to the surfaces of only the inlet zone of the flow channels and/or the outlet zone of the flow channels, more in particular the surfaces of the blades. FIG. 6 shows a closed centrifugal impeller 60 (realized as a single piece) and two of its flow channels 61 and 62; points 63, 64 and 65 belong to the inlet zone and point 66, 67 and 68 belong to the out let zone; points 63 and 67 are on the hub; points 64 and 68 are on a blade; points 65 and 66 are on the shroud; point 63 is shown as a circle in order to highlight that FIG. 5 is an enlarged view of this point; all these points 63, 64, 65, 66, 67 and 68 are exemplary points where it may be particularly beneficial to have a LDE protection according to an embodiment of the present invention; in this case, the substrate S, i.e. the body of the impeller, may be made for example of martensitic stainless steel or nickel-base alloy or cobalt-base alloy.

It is to be noted that the first impeller is usually the component of a compressor mostly affected by LDE.

Figure 7:
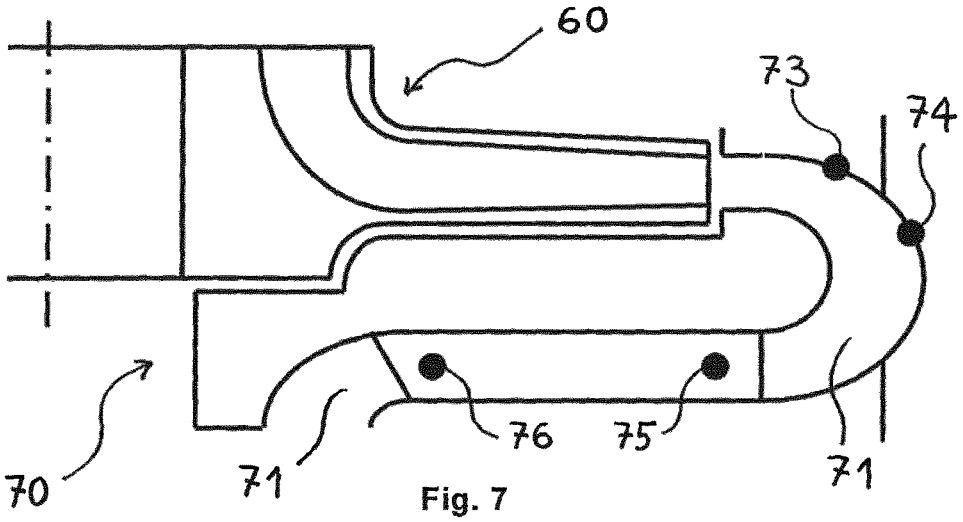
FIG. 7 shows a schematic cross-section view of a diaphragm according to an embodiment of the present invention (a centrifugal impeller is also shown)

The component of the centrifugal compressor may be a diaphragm; in this case, the surface that is exposed to fluid flow containing a liquid phase and that is covered by the protective layer may correspond to the whole internal surfaces of the return channels. FIG. 7 shows a diaphragm 70 (realized as a plurality of pieces that a fixed to each other for example by nuts and bolts) coupled to the impeller 60 of FIG. 6 and a return channel 71; points 73, 74, 75 and 76 are exemplary points where it may be particularly beneficial to have a LDE protection according to an embodiment of the present invention; point 73 is on the outside surface of an initial part of the initial U-shape portion of the return channel 71; point 74 is on the outside surface of an intermediate part of the initial U-shape portion of the return channel 71 (this point is located on the so-called "counter case"); points 75 and 76 are on a blade of the return channel 71 respectively at the begin and at the end.

The component of the centrifugal compressor may be an inlet guide vane, in short IGV, (i.e. the component located upstream the first compressor stage); in this case, the surface that is exposed to fluid flow containing a liquid phase and that is covered by the protective may correspond to all the surfaces of the component. This component is not shown in any figure.

It is to be noted that, in order to reduce manufacturing costs, the covering according to an embodiment of the present invention may be done only on some portions of the components (those that are more affected by LDE); for example the blades of the return channels of the diaphragm or the vanes of the IGV.

It is important to keep in mind that the protective layer according to an embodiment of the present invention is hard and fragile. Therefore, for example, when two pieces having such protective layer are put in contact to each other and then fixed to each other, it may be beneficial that their protective layers be not compressed; in this case, at least one and, in an embodiment, both of the regions of contact are free from such protective layer.

FIG. 8 shows very schematically first possible Cathodic Arc PVD steps for manufacturing an embodiment of a closed centrifugal impeller 60 according to an embodiment of the present invention, more specifically the covering steps.

In FIG. 8, the closed impeller 60 is arranged horizontally.

In case of an open impeller, it may be beneficial to place it so that the open side is facing down; in general, it may be beneficial that any surface to be covered is facing down during the PVT or CVD process.

Two of the many "targets" are labeled T1 and T2; during the covering steps the impeller 60 is rotated about its symmetry axis.

Figure 8A:
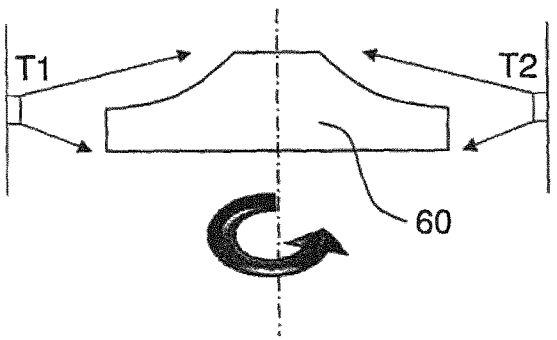
FIG. 8 shows schematically first possible Cathodic Arc PVD steps for manufacturing an embodiment of a closed centrifugal impeller according to an embodiment of the present invention.
Figure 8B:
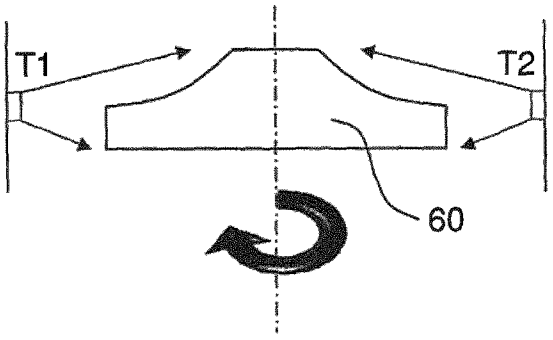

In FIG. 8, the arrows show the flow of material toward the component that is finally deposited on the component. The material flows into the flow paths of the impeller 60 and covers the outlet zone of the flow paths. In order to improve the covering of the outlet zone of the flow paths, the impeller 60 is rotated according to a first rotation sense (FIG. 8A) and then to a second rotation sense (FIG. 8B). Thanks to the rotation it is possible to cover also regions of the internal surface of the flow paths not directly seen by the targets T1 and T2.

FIG. 9 shows very schematically second possible Cathodic Arc PVD steps for manufacturing an embodiment of a closed centrifugal impeller 60 according to an embodiment of the present invention, more specifically the covering steps.

In FIG. 9, the closed impeller 60 is arranged vertically; therefore, it is possible to arrange a second closed impeller 90; during the covering steps the closed impeller 60 and the closed impeller 90 are both rotated about an axis perpendicular to their symmetry axis.

Six of the many "targets" are labeled T1, T2, T3, T4, T5 and T6.

Figure 9A:
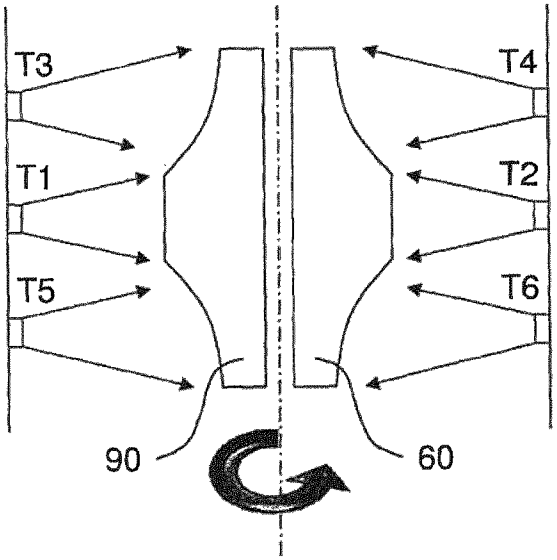
FIG. 9 shows schematically second possible Cathodic Arc PVD steps for manufacturing an embodiment of a closed centrifugal impeller according to an embodiment of the present invention.
Figure 9B:
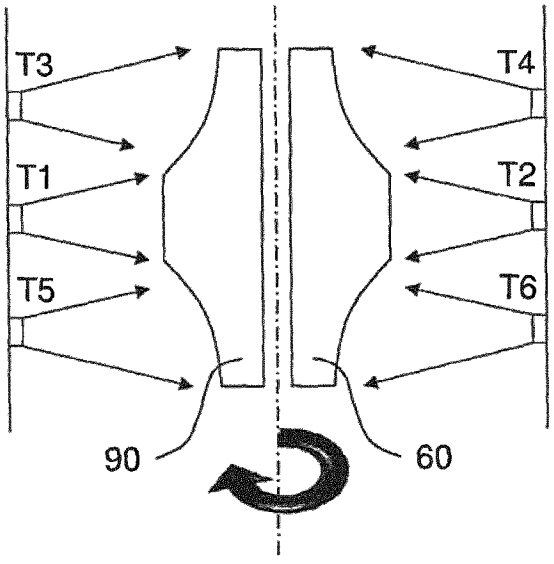

In FIG. 9, the arrows show the flow of material toward the component that is finally deposited on both the components. The material flows into the flow paths of the impellers 60 and 90 and covers the inlet zone of the flow paths. In order to improve the covering of the inlet zone of the flow paths, the impellers 60 and 90 are rotated according to a first rotation sense (FIG. 9A) and then to a second rotation sense (FIG. 9B). Thanks to the rotation it is possible to cover also regions of the internal surface of the flow paths not directly seen by the targets T1, T2, T3, T4, T5.

It is to be understood that even though numerous characteristics and advantages of various embodiments have been set forth in the foregoing description, together with details of the structure and functions of various embodiments, this disclosure is illustrative only, and changes may be made in detail, especially in matters of structure and arrangement of parts within the principles of the embodiments to the full extent indicated by the broad general meaning of the terms in which the appended claims are expressed. It will be appreciated by those skilled in the art that the teachings disclosed herein can be applied to other systems without departing from the scope and spirit of the application.

What is claimed is:

1. A method of protecting a component of a turbomachine from liquid droplets erosion, the method comprising:

covering at least one region of a component surface exposed to a flow of a fluid containing a liquid phase to be processed by the turbomachine with a protective layer, wherein the protective layer comprises a plurality of adjacent sub-layers of two materials in alternate position, wherein the materials have high hardness in the range of 1000-3000 HV and low fracture toughness below 20 $MPam^{1/2}$, and wherein a first material of the two materials is a stoichiometric nitride or carbide or boride of titanium or zirconium or chromium or tungsten or aluminum or vanadium, and a second material of the two materials is a non-stoichiometric nitride or carbide or boride of titanium or zirconium or chromium or tungsten or aluminum or vanadium.

2. The method of claim 1, wherein the materials are Titanium Nitride (TiN).

3. The method of claim 1, wherein the covering is carried out by a CVD technique.

4. The method of claim 1, wherein the covering is carried out by a PVD technique.

5. The method of claim 4, wherein "targets" for the Cathodic Arc PVD are located and/or shaped so that at least the targets see directly or indirectly parts of the at least one region of the component surface to be covered.

6. A component of a centrifugal compressor having a surface exposed to a flow of a fluid containing a liquid phase to be compressed by the centrifugal compressor, the component comprising:

at least one region of the surface covered with a protective layer, wherein the protective layer comprises a plurality of adjacent sub-layers of two materials in alternate position, wherein the materials have high hardness in the range of 1000-3000 HV and low fracture toughness below 20 $MPam^{1/2}$, and wherein a first material of the two materials is a stoichiometric nitride or carbide or boride of titanium or zirconium or chromium or tungsten or aluminum or vanadium, and a second material of the two materials is a non-stoichiometric nitride or carbide or boride of titanium or zirconium or chromium or tungsten or aluminum or vanadium.

7. The component of claim 6, wherein the component is a diaphragm, and wherein the surface exposed to fluid flow is covered by the protective layer entirely.

8. The component of claim 6, wherein the component is\an open impeller, and wherein the surface exposed to fluid flow is covered by the protective layer entirely.

9. The component of claim 6, wherein the component is a closed impeller, and wherein the surface exposed to fluid flow is covered by the protective layer only at the inlet zone of the channels and/or at the outlet zone of the channels.

10. The component of claim 6, wherein the component is an inlet guide vane, and wherein the surface exposed to fluid flow is covered by the protective layer entirely.

11. A centrifugal compressor, the centrifugal compressor comprising:

a component having a surface exposed to a flow of a fluid containing a liquid phase to be compressed by the centrifugal compressor, the component comprising:

at least one region of the surface covered with a protective layer, wherein the protective layer comprises a plurality of adjacent sub-layers of two materials in alternate position, wherein the materials have high hardness in the range of 1000-3000 HV and low fracture toughness below 20 $MPam^{1/2}$, and wherein a first material of the two materials is a stoichiometric nitride or carbide or boride of titanium or zirconium or chromium or tungsten or aluminum or vanadium, and a second material of the two materials is a non-stoichiometric nitride or carbide or boride of titanium or zirconium or chromium or tungsten or aluminum or vanadium.

12. The centrifugal compressor of claim 11, wherein the centrifugal compressor comprising a combination of components.

13. The centrifugal compressor of claim 11, wherein the bulk material of the or each component is martensitic stainless steel or nickel-base alloy or cobalt-base alloy.

14. An axial compressor, wherein at least the blades of the first stage or stages have a protective layer for their protection according to claim 1.

15. A steam turbine, wherein at least the blades of the last stage or stages have a protective layer for their protection according to claim 1.

16. The centrifugal compressor of claim 12, wherein the bulk material of the or each component is martensitic stainless steel or nickel-base alloy or cobalt-base alloy.

17. The method of claim 1, wherein the covering is carried out by a Cathodic Arc PVD.

18. The centrifugal compressor of claim 11, wherein the component is a diaphragm, and wherein the surface exposed to fluid flow is covered by the protective layer entirely.

19. The centrifugal compressor of claim 11, wherein the component is an open impeller, and wherein the surface exposed to fluid flow is covered by the protective layer entirely.

20. The centrifugal compressor of claim 11, wherein the component is a closed impeller, and wherein the surface exposed to fluid flow is covered by the protective layer only at the inlet zone of the channels and/or at the outlet zone of the channels.

21. The centrifugal compressor of claim 11, wherein the component is an inlet guide vane, and wherein the surface exposed to fluid flow is covered by the protective layer entirely.

* * * * *